United States Patent [19]

White et al.

[11] Patent Number: 4,856,585

[45] Date of Patent: Aug. 15, 1989

[54] TUBING CONVEYED SAMPLER

[75] Inventors: Kevin M. White, Tequesta, Fla.; Harold K. Beck, Duncan, Okla.

[73] Assignee: Halliburton Company, Duncan, Okla.

[21] Appl. No.: 209,116

[22] Filed: Jun. 16, 1988

[51] Int. Cl.[4] ..... F21B 49/08

[52] U.S. Cl. ..... 166/250; 166/264; 166/323

[58] Field of Search ..... 166/250, 264, 386, 373, 166/374, 116, 162, 319, 321, 322, 323; 73/151

[56] References Cited

U.S. PATENT DOCUMENTS

| | | | |
|---|---|---|---|
| Re. 29,562 | 3/1978 | Wray et al. | 166/0.5 |
| Re. 29,638 | 5/1978 | Nutter | 73/151 |
| 3,858,649 | 1/1975 | Wray et al. | 166/162 |
| 4,044,829 | 8/1977 | Jessup et al. | 166/323 X |
| 4,047,564 | 9/1977 | Nix et al. | 166/72 |
| 4,063,593 | 12/1977 | Jessup | 166/317 |
| 4,064,937 | 12/1977 | Barrington | 166/162 |
| 4,270,610 | 6/1981 | Barrington | 166/317 |
| 4,311,197 | 1/1982 | Hushbeck | 166/373 |
| 4,502,537 | 3/1985 | Cater, Jr. | 166/162 |
| 4,553,598 | 11/1985 | Meek et al. | 166/317 |
| 4,665,983 | 5/1987 | Ringgenberg | 166/250 |
| 4,711,123 | 12/1987 | Christensen | 73/151 |
| 4,753,292 | 6/1988 | Ringgenberg et al. | 166/250 |

FOREIGN PATENT DOCUMENTS 2132250 4/1984 United Kingdom .

OTHER PUBLICATIONS

Schlumberger Company Brochure SMP-4610 (4 87) "Flo-Star 15,000 Psi, Full-Bore, Annular Sample Chamber (ASC)", 1987.

Ruska "Subsurface Sampler: Model 1200" Brochure, pp. 22 and 23.

*Primary Examiner*—William P. Neuder

*Attorney, Agent, or Firm*—L. Wayne Beavers; Mark E. McBurney

[57] ABSTRACT

A sampler apparatus for use in a well includes a housing having a full opening bore therethrough. A first removable sample chamber for trapping a well fluid sample is removably disposed in the housing in a location such as to avoid restricting the full opening bore regardless of whether the sample chamber is in an open or closed position. Preferably a plurality of such sample chambers are provided.

20 Claims, 6 Drawing Sheets

TUBING CONVEYED SAMPLER

BACKGROUND OF THE INVENTION

1. Field Of The Invention

The present invention relates generally to apparatus for collecting well fluid samples, and more particularly, but not by way of limitation, to apparatus for simultaneously collecting multiple pressurized well fluid samples suitable for laboratory PVT analysis.

2. Description of The Prior Art

Often during the testing of an oil or gas well it is desirable to trap a sample of the well fluid downhole. The prior art includes many devices which are useful to take such samples. The sampling devices may either be tubing conveyed or wireline conveyed and can be actuated in any number of ways.

One often preferred sampling procedure utilizes a tubing conveyed sampling device which is actuated in response to changes in well annulus pressure. Typical examples of such annulus pressure responsive sampling devices are described in U. S. Patent Nos. Re. 29,562; Re. 29,638; 3,858,649; 4,047,564; 4,063,593; 4,064,937; 4,270,610; 4,311,197; 4,502,537; 4,553,598; and in United Kingdom Patent Application GB No. 2132250A.

For the most part, these prior devices have been unsuitable for laboratory PVT analysis for two reasons. First, they are large and heavy and difficult to transport to and handle in the laboratory. Second, they often will leak off gas pressure so that true downhole conditions cannot be recreated in the laboratory.

One example of a sampling apparatus capable of obtaining a pressurized sample suitable for laboratory PVT analysis is shown in U. S. Pat. No. 4,665,983 to Ringgenberg, and assigned to the assignee of the present invention. The Ringgenberg device traps a sample in an annular space 400 as depicted in FIG. 2A thereof.

Another device recently introduced for obtaining pressurized samples suitable for PVT laboratory analysis is that marketed by the Schlumberger Company as its FLO-STAR brand sample chamber as illustrated in Schlumberger brochure SMP-4610 (4 87). The Schlumberger device also utilizes an annular sample chamber defined within the tool housing.

Another feature which is desirable in a sampling device, and which is found in both the Ringgenberg and Schlumberger devices, is that the sample chamber have a full opening bore that remains open even after the sample chamber has been closed to trap a sample. This permits standard perforating guns, actuating devices and the like to be passed through the sample chamber after the sample has been taken, or in the event that the sample chamber is prematurely actuated and closed.

Another desirable feature which is found in the Ringgenberg device is the incorporation of a time delay means which provides a time delay between the actuation of the device and the final closure of the sampler. This permits the sampling device to be placed in a well test string below a tester valve which controls flow of well fluid through the test string. The taking of a shut-in fluid sample is accomplished by first increasing annulus pressure to open both the tester valve and to actuate the sampler, and then releasing a portion of the annulus pressure to close the tester valve before the sample chamber has itself closed. When this occurs, the sample obtained by the sampling chamber will be a shut-in sample as opposed to a flowing sample.

Although both the Ringgenberg and Schlumberger devices are capable of obtaining pressurized well fluid samples suitable for laboratory PVT analysis, they both have the significant disadvantage that the sample is trapped in an annular chamber defined within the tool housing, and the entire tool housing must be transported to the laboratory. Typically, the tool housing will have an outside diameter on the order of five to five and one-half inches, and the tool will have a length on the order of six to seven feet. The weight of the tool and the contained sample will typically be on the order of eighty pounds, thus providing a very large and heavy apparatus which must be transported to the laboratory. Furthermore, laboratory procedures may require the heating of the entire mass of the tool to bottom hole temperatures for analysis purposes.

The prior art does include smaller sampling devices, but these have been wireline conveyed samplers rather than tubing conveyed samplers. One example of such a wireline conveyed sampler is the Ruska subsurface sampler model 1200 which is designed to trap pressurized samples for laboratory PVT analysis. The use of wireline devices is often undesirable, however. It is difficult to seal around a wireline and thus there is a safety problem when taking wireline samples on a flowing well. Also, a significant expense is incurred in bringing wireline equipment and operators to the well site.

SUMMARY OF THE INVENTION

The present invention provides an improved tubing conveyed sampler apparatus which includes a removable sampler chamber of relatively small size which is capable of trapping a pressurized well fluid sample suitable for laboratory PVT analysis.

The apparatus can contain a plurality of such removable sample chambers.

The apparatus desirably provides a full opening bore therethrough even when the sample chambers are in a closed position. This is accomplished by locating the plurality of removable sample chambers within a housing of the apparatus so that the removable sample chambers are radially offset so as not to restrict the full opening bore of the apparatus.

The apparatus is operable in response to changes in well annulus pressure, and further includes a time delay means for providing a time delay between the change in well annulus pressure and complete closure of the individual sample chambers. This permits the apparatus to be utilized to take either flowing well samples or shut-in well samples.

The apparatus further includes latch means associated with the sample chambers for latching the sample chambers closed after a well fluid sample is trapped therein. This prevents contamination of the samples during reverse circulation procedures.

Numerous objects, features and advantages of the present invention will be readily apparent to those skilled in the art upon a reading of the following disclosure when taken in conjunction with the accompanying drawings.

OVERALL WELL TESTING ENVIRONMENT

Figure 1:
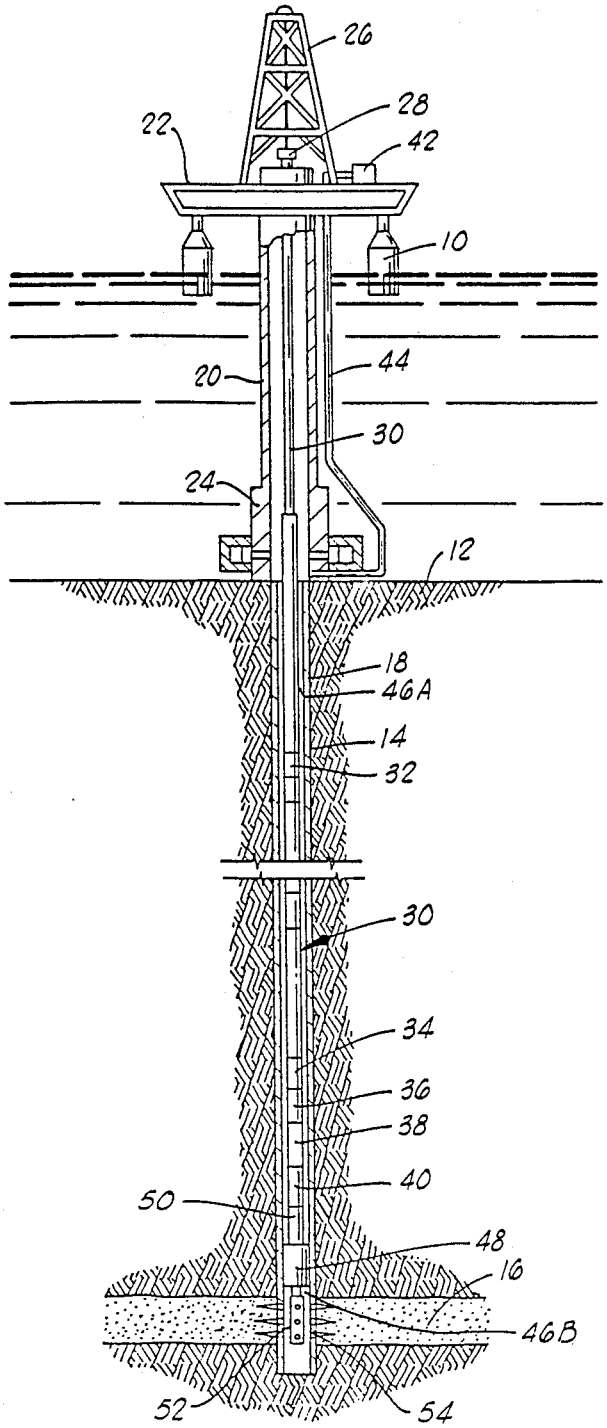
FIG. 1 is a schematic vertically sectioned view of a representative offshore installation which may be employed for testing purposes and illustrates a formation testing string or tool assembly in position in a submerged well bore and extending upwardly to a floating operating and testing station.

Referring to FIG. 1 of the present invention, a testing string for use in an offshore oil or gas well is schematically illustrated.

In FIG. 1, a floating work station 10 is centered over a submerged oil or gas well located in the sea floor 12 having a well bore 14 which extends from the sea floor 12 to a submerged formation 16 to be tested.

The well bore 14 is typically lined by steel casing 18 cemented into place. A subsea conduit 20 extends from a deck 22 of the floating work station 10 into a well head installation 24. The floating work station 10 has a derrick 26 and a hoisting apparatus 28 for raising and lowering tools to drill, test, and complete the oil or gas well.

A testing string 30 has been lowered into the well bore 14 of the oil or gas well. The testing string 30 includes such tools as one or more pressure balanced slip joints 32 to compensate for the wave action of the floating work station 10 as the testing string is being lowered into place, a circulation valve 34, a tester valve 36, and the sampler apparatus 38 of the present invention.

As is explained in more detail below, the relative positions of the tester valve 36 and sampler apparatus 38 may be reversed. Also, the testing string 30 can be run without the tester valve 36.

A check valve 40 which is annulus pressure responsive may be located in the testing string below the sampler valve 38 of the present invention.

The tester valve 36, circulation valve 34, check valve 40, and sampler apparatus 38 are operated by fluid annulus pressure exerted by a pump 42 on the deck of the floating work station 10. Pressure changes are transmitted by a pipe 44 to the well- annulus 46 between the casing 18 and the testing string 30.

Well annulus pressure is isolated from the formation 16 to be tested by a packer means 48 set in the well casing 18 just above the formation 16 thus defining the well annulus 46 and dividing the well annulus 46 into an upper well annulus portion 46A above the packer 48 and a lower well annulus portion 46B below the packer 48.

The testing string 30 includes a tubing seal assembly 50 at the lower end thereof which stings into or stabs through a passageway through the packer 48 for forming a seal therewith. Check valve 40 relieves pressure built up in testing string 30 below tester valve 36 as the seal assembly 50 stabs into the packer 48.

A perforating gun 52 may be run via wireline to or may be disposed on a tubing string at the lower end of the testing string 30 to form perforations 54 in casing 18, thereby allowing formation fluids to flow from the formation 16 into the flow passage of the testing string 30 via perforations 54. Alternatively, the casing 18 may have been perforated prior to running the testing string 30 into the well bore 14.

The apparatus illustrated in FIG. 1 may be utilized to conduct a formation test controlling the flow of fluid from the formation 16 through the flow channel in the testing string 30 by applying and releasing fluid annulus pressure to the well annulus 46A by pump 42 to operate circulation valve 34, tester valve 36, sampler apparatus 38 and check valve 40 and the measuring of the pressure buildup curves and fluid temperatures curves with appropriate pressure and temperature sensors in the testing string 30.

A more detailed description of many of the components of the typical testing string just described may be found in Ringgenberg U.S. Pat. No. 4,665,983 which is incorporated herein by reference.

DETAILED DESCRIPTION OF THE PREFERRED EMBODIMENTS

A preferred embodiment of the sampler apparatus 38 of the present invention is shown in FIGS. 2A–2E.

The sampler apparatus 38 includes a cylindrical housing assembly 56 comprised of a plurality of threadedly connected housing sections. The housing assembly 56 includes an upper housing adapter 58, a shear set housing section 60, a power housing section 62, a splined housing section 64, a sample chamber housing section 66, and a lower housing adapter 68.

The upper housing adapter 58 and shear set housing section 60 are connected together at threaded connection 70 with an O-ring seal 72 being provided therebetween.

The shear set housing section 60 and power housing section 62 are connected together at threaded connection 74 with a seal being provided therebetween by O-ring 76.

The power housing section 62 and splined housing section 64 are connected together at threaded connection 78 with a seal being provided therebetween by O-ring 80.

The splined housing section 64 and sample chamber housing section 66 are connected together at threaded connection 82 with a seal being provided therebetween by O-ring 84.

The sample chamber housing section 66 and lower housing adapter 68 are connected together at threaded connection 86 with a seal being provided therebetween by O-ring 88.

The upper housing adapter 58 has an internal threaded box connection 90 for connection of the sampler apparatus 38 to the lower end of tester valve 36 or other component of testing string 30 located immediately thereabove as shown in FIG. 1.

The lower housing adapter 68 has an externally threaded pin connection 92 thereon for connection of the lower end of sampler apparatus 38 to the check valve 40 or other portion of testing string 30 located immediately therebelow as shown in FIG. 1.

As is further described below, the housing assembly 56 has a number of other components of the sampler apparatus 38 contained therein. There is defined through the apparatus 38, and generally through the housing assembly 56, a central bore or passageway 94. Although the bore or passageway 94 is generally cylindrical in shape, and will be referred to as having a diameter 96 (see FIG. 3), it will be understood that the bore or passageway 94 is not necessarily circular at all cross sections taken through their apparatus 38, and is not of a uniform diameter at all cross sections. The bore or passageway 94 of the apparatus 38 preferably is a "full opening" bore or passageway. As used herein, "full opening bore" means that the bore extends straight through the tool and at its most restricted points, the bore or passageway 94 has a minimum internal dimension or diameter 96 sufficient to allow passage therethrough of standard tools such as actuating bars, wireline conveyed perforating guns and the like which it may be necessary or desirable to pass through the apparatus 38. In the preferred embodiment of the present invention, the full opening bore or passageway 94 has a minimum diameter of 2.0 inches for a tool having a five-inch outside diameter.

Figure 2A:
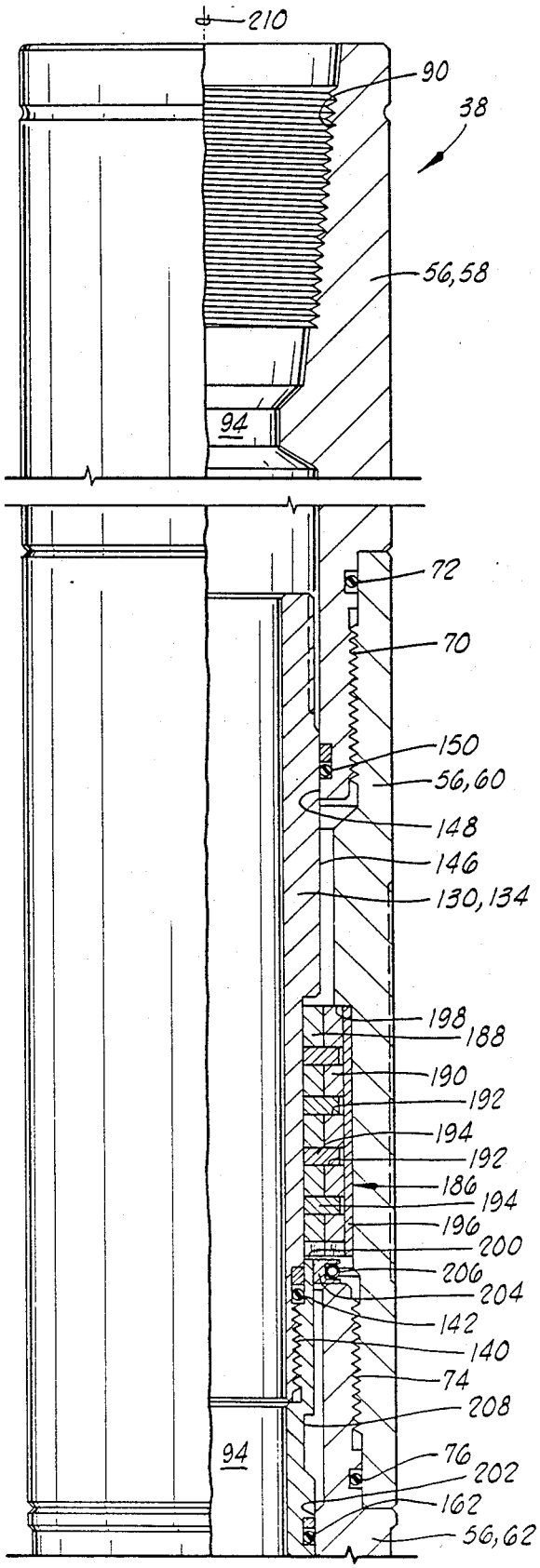
FIGS. 2A–2E an elevation right side only sectioned view of a preferred embodiment of the sampler apparatus of the present invention.
Figure 2B:
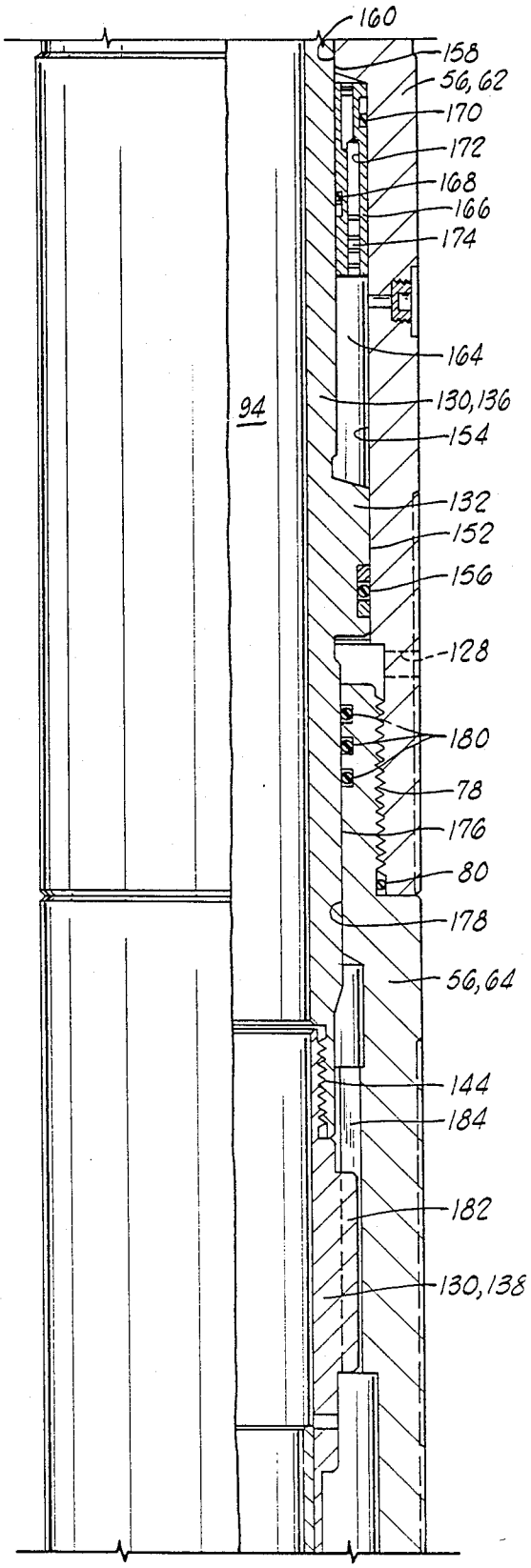
Figure 2C:
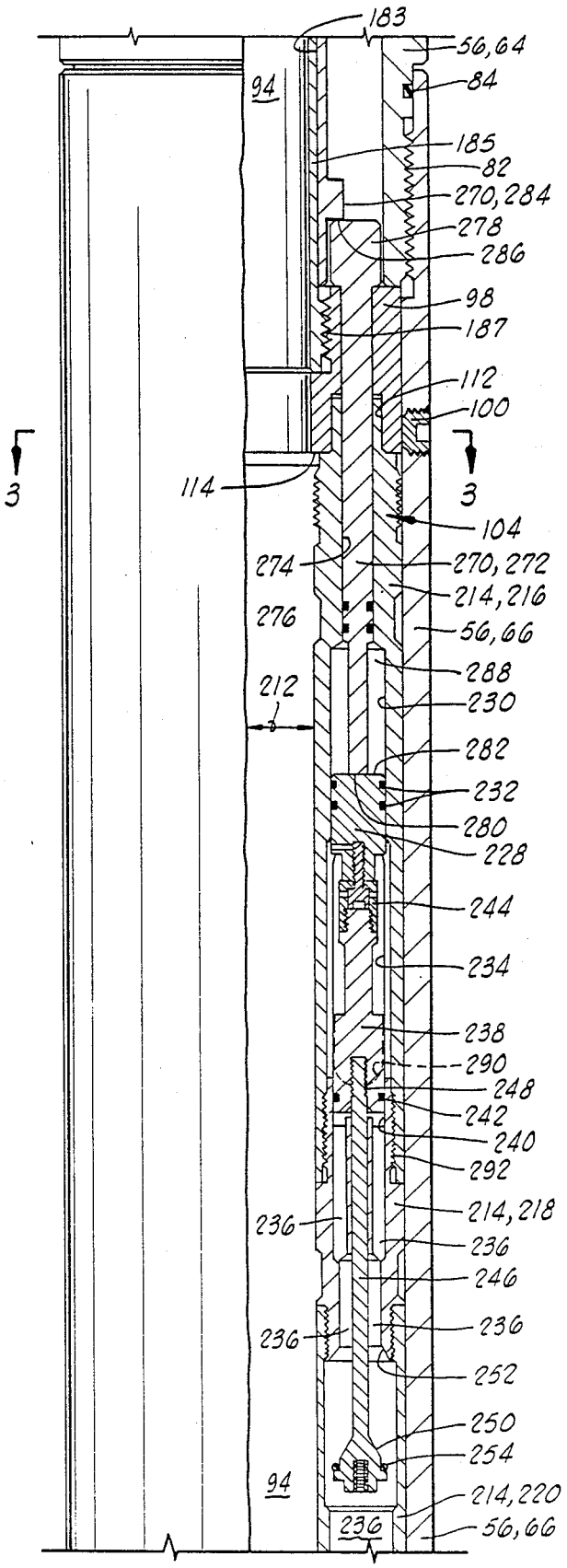
Figure 3:
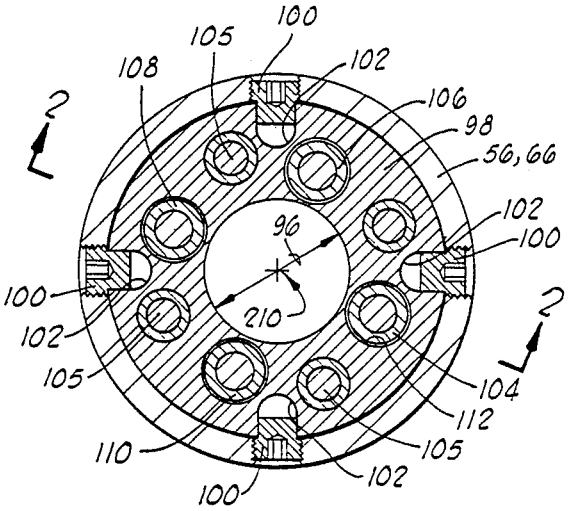
FIG. 3 is a sectioned view taken along line 3—3 of FIG. 2.

Referring to FIG. 2C, an upper annular hanger 98 is closely received in an upper end of sample chamber housing section 66 and fixedly attached thereto by a plurality of radially oriented set screws 100 which are threadedly disposed through the wall of sample chamber housing section 66 and received in blind bores 102 of upper hanger 98 as best seen in FIG. 3.

As best seen in FIGS. 2C–2E and FIG. 3, there are four removable sample chambers 104, 106, 108 and 110 which have their upper ends received in vertical radially offset counterbores such as 112 disposed in a lower end 114 of upper hanger 98.

The sample chambers 104, 106, 108 and 110 are located within the sample chamber housing section 66 at substantially equal elevations, and are circumferentially spaced from each other as shown in FIG. 3 about the longitudinal axis 210 of the sampler apparatus 38.

It is not necessary to run all four sample chambers illustrated in FIG. 3. Also, it is possible to substitute various measuring devices such as a pressure gauge or temperature gauge in place of one or more of the sample chambers.

Figure 2D:
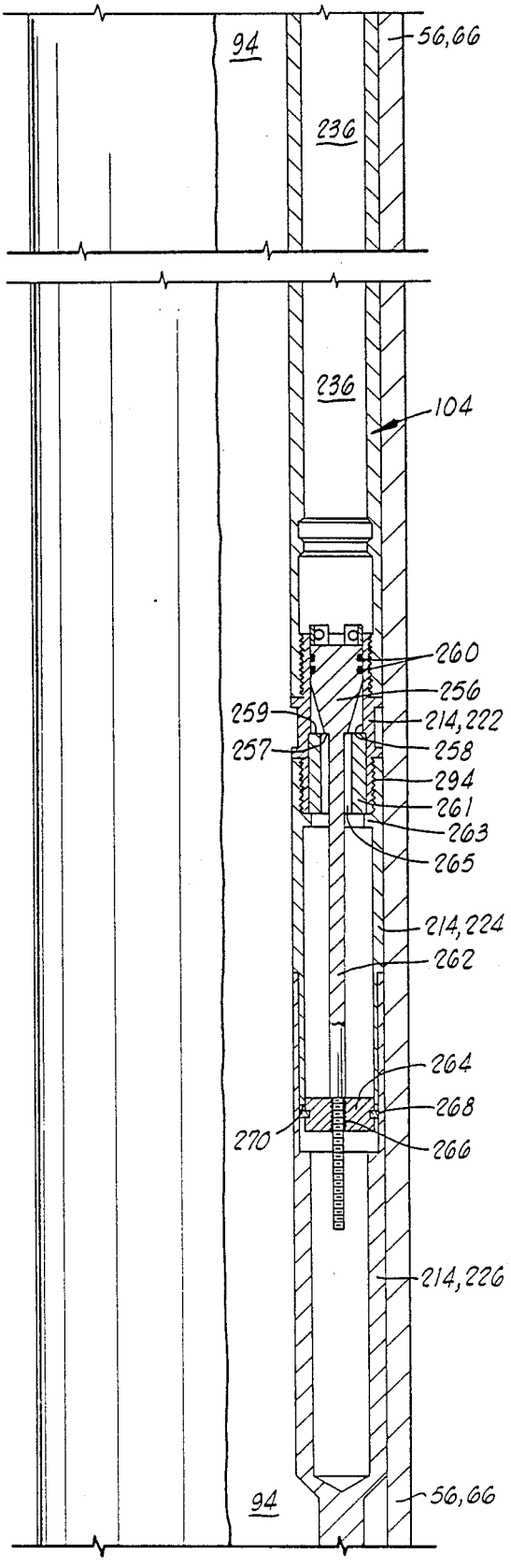
Figure 2E:
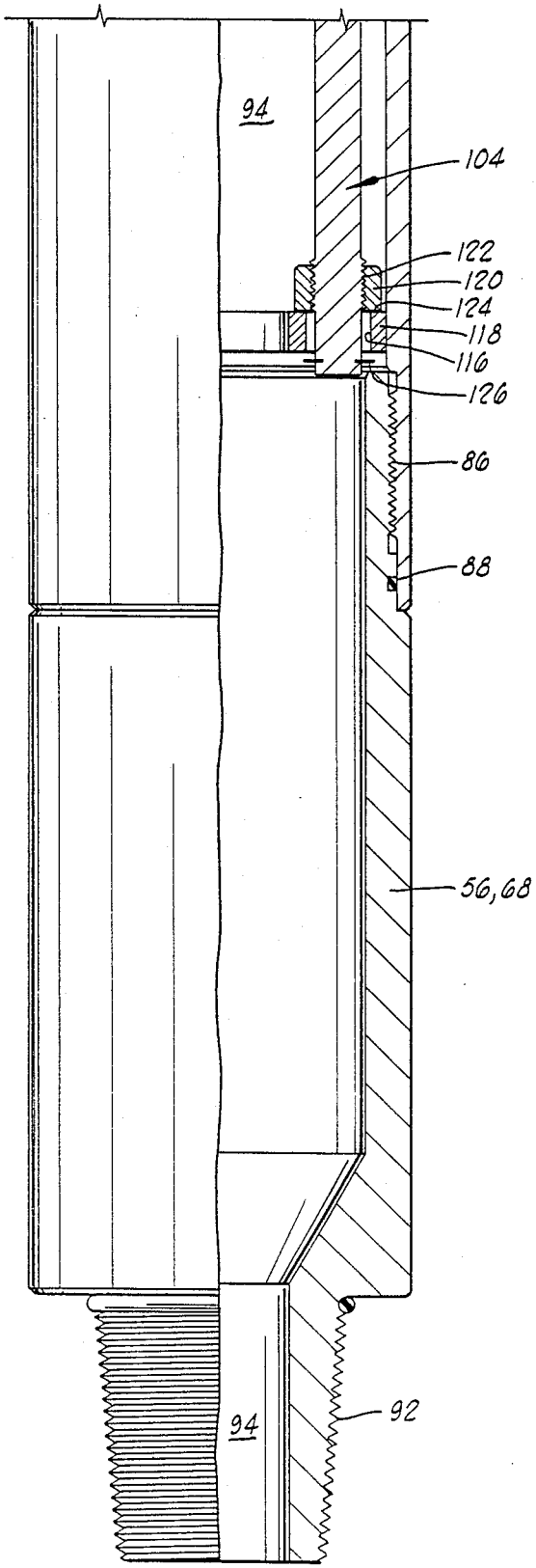

As seen in FIG. 2E, the lower ends of each of the sample chambers such as 104 are received through openings such as 116 disposed through an annular lower hanger ring 118. The lower hanger ring 118 serves merely to radially locate the lower ends of the sample chambers within the lower portion of the sample chamber housing section 66. Lower hanger ring 118 is n fact loosely received within the sample chamber housing section 66. The lower portion of each sample chamber such as 104 has a retaining nut 120 connected thereto at threaded connection 122. The retaining nut 120 rests upon an upper surface 124 of lower hanger ring 118. An annular lock ring 126 is disposed in a groove in the lower end of sample chamber 104 below the lower hanger ring 118.

As best seen in FIG. 3, there are four elongated support rods 105 which support lower hanger ring 118 from upper hanger 98.

It will be apparent that the sample chambers 104, 106, 108 and 110 may be removed from the sampler apparatus 38 merely by disconnecting the lower housing adapter 66 from the sample chamber housing section 66 at threaded connection 86 and sliding the lower hanger ring 118 and the four sample chambers out of the sample chamber housing section 66.

The sample chambers 104, 106, 108 and 110 are is suitable for trapping a pressurized well fluid sample suitable for laboratory PVT analysis. The sample chambers are designed so that gas pressure from the formation will not leak out of the chambers.

Referring to FIG. 2B, the power housing section 62 has a power port 128 disposed through a wall thereof.

A differential pressure mandrel assembly 130 has a piston means 132 defined thereon for sliding the mandrel assembly 130 within the housing assembly 56 in response to fluid pressure exterior of the housing assembly 56 communicated to the piston means 132 through the power port 128.

The differential pressure mandrel assembly 130 includes an upper portion 134, an intermediate portion 136, and a splined lower portion 138.

Upper mandrel portion 134 is connected to intermediate mandrel portion 136 at threaded connection 140 with a seal being provided therebetween by O-ring 142. The intermediate mandrel portion 136 is connected to the splined lower mandrel portion 138 at threaded connection 144.

The upper mandrel portion 134 has a cylindrical outer surface 146 closely received within a counterbore 148 of upper housing adapter 58 with a seal being provided therebetween by O-ring 50.

The intermediate mandrel portion 136 has the piston means 132 defined thereon as an enlarged portion thereof. Piston means 132 includes an outer cylindrical surface 152 closely slidably received within a counterbore 154 of power housing section 62 with a piston ring seal 156 being provided therebetween.

An upper outer cylindrical surface 158 of intermediate mandrel portion 136 is closely received within a bore 160 of power housing section 62 with a sliding seal being provided therebetween by O-ring 162.

An annular oil chamber 164 is defined between intermediate mandrel portion 136 and power housing section 62 above the piston means 132.

An annular metering cartridge 166, which may generally be described as a time delay means 166, is received within the upper end of oil chamber 164 with seals being provided between the metering cartridge 166 and the intermediate mandrel portion 136 and the power housing section 62 by seals 168 and 170, respectively.

The metering cartridge 166 has a metering passage 172 disposed longitudinally therethrough within which is disposed a metering jet 174 having a restricted orifice for impeding the flow of oil upward from oil chamber 164 through the metering cartridge 166 in order to impede upward movement of differential pressure mandrel assembly 130 in a manner further described below.

A lower outer cylindrical surface 176 of intermediate mandrel portion 136 below piston means 132 is closely received within a bore 178 of splined housing section 64 with a seal being provided therebetween by a plurality of O-rings 180.

The sampler apparatus 38 is provided with an internal pressure balance feature due to the fact that the diameter of each of the seals 150, 162, and 180 is equal. As a result, internal pressure within the apparatus 38 does not create any longitudinal force on the differential pressure mandrel 130 or other components operably associated therewith.

The splined lower mandrel portion 138 includes a plurality of radially outward extending splines 182 which are received between a plurality of radially inward extending splines 184 of splined housing section 64 to prevent rotation of the differential pressure mandrel assembly 130 relative to the cylindrical housing assembly 56.

The splined lower mandrel portion 138 has an inner bore 183 closely received about a cylindrical guide tube 185 which extends upwardly from upper hanger 98. The guide tube 185 is threadedly connected to hanger 98 at threaded connection 187.

Referring to FIG. 2A, an annular shear pin set 186 is located between the upper mandrel portion 134 and the shear set housing section 60. The shear pin set 186 may generally be referred to as a frangible, releasable retaining means operably associated with the differential pressure mandrel assembly 130 for releasably retaining the mandrel assembly 130 against sliding movement relative to the housing assembly 56 until a pressure differential across the piston means 132 reaches a predetermined level.

The shear pin set 186 includes inner and outer concentric cylindrical pin receiving sections 188 and 190, respectively. A plurality of pin bores 192 are disposed radially through both the inner and outer concentric sections 188 and 190, and frangible shear pins 194 are received therein. A cylindrical sleeve 196 surrounds the outer concentric section 198 for retaining the pins 194 in place.

When the sampler apparatus 38 is first assembled and run into the well, before actuation thereof, the shear pin set 186 appears as shown in FIG. 2A, and is longitudinally trapped between a downward facing annular shoulder 198 of shear set housing section 60 and an upward facing annular shoulder 200 defined on the upper end of intermediate mandrel portion 136.

When the sampler apparatus 38 is first run into a well, the oil chamber 164 will be substantially filled with oil, having a slight air volume for reasons to be shortly described, and will be at substantially atmospheric pressure. When the pressure in the well annulus communicated through the power port 128 to the lower side of power piston 132 is increased, an upward pressure differential and upward acting force will be created across the piston means 138. Initially, any upward motion of the mandrel assembly 130 will be prevented by the shear pin set 186. When the upward force exerted by the shoulder 200 against the lower end of inner concentric section 188 reaches a predetermined level, the shear pins 194 will shear thus releasing the mandrel assembly 130 so that it can slide upward relative to the housing assembly 38.

As mentioned, the oil in oil chamber 164 will have a small amount of air entrapped therein. This will give the oil in oil chamber 164 sufficient compressibility to allow for an initial movement of mandrel assembly 130 sufficient for the seal 162 to move upward past the upper edge 202 of bore 160 thus breaking the seal provided by O-ring 162 and permitting oil from oil chamber 164 to be metered upward through metering cartridge 166.

As will be understood by those skilled in the art, the number, size and material of construction of the pins 194 may be chosen so as to determine the approximate well annulus pressure at which the shear set 186 will release the mandrel assembly 130.

The upward motion of the mandrel assembly 130 will be retarded for a period ranging from a few seconds to as much as an hour or more depending upon the choice of the metering jet 174, as will also be understood by those skilled in the art.

When the mandrel assembly 130 reaches its upwardmost position, a set of locking dogs 204 will be biased inward by a garter spring 206 to be received in a groove 208 thus locking the actuating mandrel 130 in an upwardmost position.

Turning now to FIGS. 2C–2E, the sample chamber 104 will be further described.

The sample chamber 104 is an elongated cylindrical sample chamber disposed in the sample chamber housing section 66 substantially parallel to a longitudinal axis 210 (see FIG. 2A) of the housing assembly 56.

The sample chamber 104 is radially offset from the central axis 210 of housing assembly 56 by a distance 212 so as not to restrict the full opening bore 94 of the housing assembly 56. The sample chamber 104 has an outside diameter after removal from housing assembly 56 of no greater than one-half the difference between the outside diameter of sample chamber housing section 66 and the diameter of full opening bore 94.

The sample chamber 104 includes a sample chamber housing assembly 214 including an upper end portion 216, an upper valve portion 218, a sample volume portion 220, a lower valve portion 222, a latch chamber portion 224, and a lower end portion 226.

The upper end portion 216 is received in the upper hanger 98 as previously described, and the lower end portion 226 is received in the lower hanger ring 118 as previously described.

A piston 228 is slidably received within an inner bore 230 of upper end portion 216 with a pair of piston ring seals 232 disposed therebetween.

An oval shaped flow port 234 is disposed through a sidewall of upper end portion 216 below the piston 228 for communicating the interior bore 94 of the housing assembly with an interior 236 of the sample chamber 104.

A sliding valve plug 238 is slidably received within a counterbore 240 of upper valve portion 218 and provides a seal therein at O-ring 242 located below the flow port 234 to initially isolate the flow port 234 from the interior 236 of sample chamber 104 thus initially preventing any flow of fluid from the inner bore 94 of housing assembly 56 into the sample chamber 104.

The valve plug 238 is threadedly connected to the piston 228 by a connector assembly 244.

A valve stem 246 is threadedly connected to valve plug 238 at threaded connection 248. A tapered conical valve head 250 is formed on the lower end of valve stem 246 and is arranged for subsequent sealing engagement with a valve seat 252 defined on the lower end of upper valve portion 216. An O-ring seal 254 disposed in the valve head 250 assists in sealing between the valve head 250 and the valve seat 252.

Referring now to FIG. 2D, the lower end of the interior 236 of sample chamber 104 is permanently sealed by a lower valve head 256 received in a bore 258 of lower portion 222 of sample chamber housing assembly 214, with a seal being provided therebetween by O-rings 260.

Downward movement of lower valve head 256 is limited by engagement of a downward facing annular shoulder 257 thereof with an upper end 259 of a valve support ring 261 which sits on an inwardly directed flange 263 of latch chamber portion 224.

Valve support ring 261 has a plurality of inwardly directed splines 265 with grooves therebetween, and the lower shoulder 257 of lower valve head 256 actually sits on the upper end of the splines 265.

Lower valve head 256 has a lower valve stem 262 extending downwardly therefrom, having an annular anchor ring 264 threadedly attached thereto at 266. An annular lock ring 268 disposed in a groove of anchor ring 264 is located below a lower end 270 of latch chamber portion 244 of sample chamber housing assembly 214, to latch the lower valve head 256 permanently in place within the bore 258.

Thus, in its initial position as illustrated in FIGS. 2C–2E, the sample chamber 104 has its interior 236 sealed at its lower end by lower valve head 256 and at its upper end by valve plug 238. When the tool is initially run into the well, the interior 236 of sample chamber 104 will normally contain air at ambient pressure. By having the valve chamber 104 sealed at both its upper and lower ends, there will be no flow of well fluids, and thus no entry of contaminants or debris into the sample chamber 104 prior to the time that it is actually desired to trap a sample therein, as is described below.

The sampler apparatus 38 includes an actuating means generally designated by the numeral 270 (see FIG. 2C) operably associated with the differential pressure mandrel assembly 130 and the sample chamber 104 for actuating the sample chamber 104 to allow it to trap a sample in response to sliding movement of the differential pressure mandrel assembly 130 within the housing assembly 56.

The actuating means 270 includes an elongated cylindrical actuating pin 272 closely received within a bore 274 of upper sample chamber housing end portion 216, with sliding seals provided therebetween by O-rings 276. The actuating pin 272 includes an enlarged diameter head 278 formed on the upper end thereof.

A lower end 280 of actuating pin 272 freely engages an upper end 282 of piston 228 to initially hold the piston 228, valve plug 238, and upper valve head 250 in the initial positions illustrated in FIG. 2C wherein the upper valve 250,252 is in an open position, but the upper end of sample chamber interior 236 is still closed by valve plug 238 blocking the flow port 234.

The actuating means 270 can further be considered to include an annular outwardly extending flange 284 defined near the lower end of splined lower portion 138 of differential pressure mandrel pressure assembly 130. Initially, a lower shoulder 286 of flange 284 engages the upper end of enlarged head 278 of actuating pin 272 to hold the actuating pin in the position shown in FIG. 2C.

Upon upward movement of the operating mandrel assembly 130 within the housing assembly 56, the flange 284 will no longer hold the actuating pin 272 in its initial position.

Then an upward pressure differential acting across the piston 228 will move the piston 228, actuating pin 272, valve plug 238, and upper valve head 250 upward within the sample chamber 104.

This upward pressure differential across piston 228 is caused by the difference in pressure between the well fluid pressure in inner bore 94 which communicates through the flow port 234 to the lower side of piston 228, and substantially atmospheric pressure which is trapped in an air chamber 288 above the piston 228.

As the piston 228 moves upward, the valve plug 238 will first pass above a lower extremity 290 of flow port 234 thus opening the sample chamber 104 and allowing well fluid from the interior 94 of sampler apparatus 38 to rush into the interior 236 of sample chamber 104.

Further upward movement of piston 228 will pull the upper valve head 250 into sealing engagement with the upper valve seat 252 thus closing the sample chamber 104 to trap the well fluid sample in the interior thereof.

As previously mentioned there are multiple sample chambers 104, 106, 108, and 110, all of which will be simultaneously actuated in the manner just described, so that multiple well fluid samples are trapped.

TRANSPORTION AND REMOVAL OF SAMPLES

After the well fluid samples have been trapped by the sampler apparatus 38, the testing string 30 will be removed from the well bore 14.

The individual sample chambers 104, 106, 108 and 110 can then be removed from the sampler apparatus 38 by breaking the threaded connection 86 between sample chamber housing section 66 and lower housing adapter 68, and sliding the individual sample chambers such as 104 out of the lower end of the sampler apparatus 38.

After the sample chamber 104 is removed from the sampler apparatus 38, the upper end portion 216 and latch chamber portion 224 of the sample chamber housing assembly 214 are removed as follows.

A threaded connection 292 is broken between upper end portion 216 and upper valve portion 218 of sample chamber housing assembly 214 to remove the upper end portion 216.

Another threaded connection 294 is broken between lower valve portion 222 and latch chamber portion 224 to remove the latch chamber portion 224 and lower end portion 226 of sample chamber housing assembly 214.

When this is done, the upper and lower valve heads 250 and 256, respectively, will remain closed because the internal pressure of the sample trapped within interior 236 of sample chamber 104 will greatly exceed the ambient external pressure.

Figure 4A:
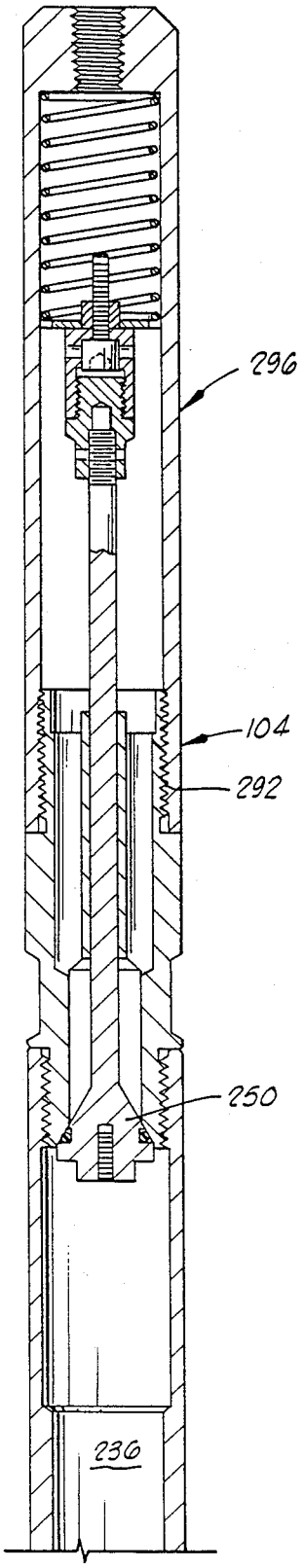
FIGS. 4A–4B comprise an elevation sectioned view of one of the removable sample chambers after having been removed from the sampler apparatus. Head assemblies have been attached to the sample chamber for use in transport of the sample chamber and subsequent removal of the sample therefrom.
Figure 4B:
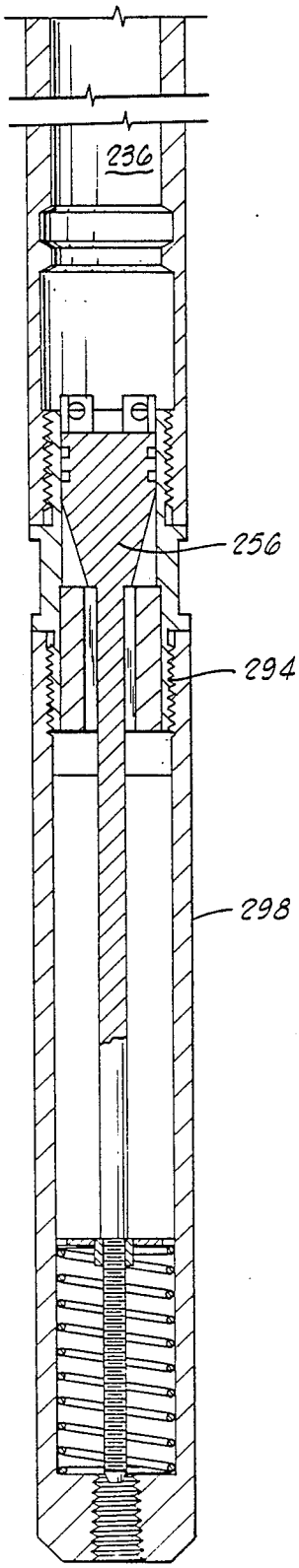

Upper and lower transport and sample removal assemblies 296 and 298, respectively, are then connected to the sample chamber 104 at threaded connections 292 and 294 as illustrated in FIGS. 4A–4B. With the sample chamber 104 in the condition illustrated in FIGS. 4A–4B, it is ready for transport to the laboratory. Once the sample chamber is received at the laboratory, the sample may be removed therefrom by a combination of pressure and/or mechanical actuation of the upper and lower valve heads 250 and 256 to open them, in a manner that will be readily apparent to those skilled in the art.

The sample chamber 104 provides a relatively small sample chamber as compared to those utilized in prior art tubing conveyed pressure actuated samplers. The sample chamber 104 may be reliably, easily and safely transported to and handled in the laboratory.

The sample chamber 104 is a modified form of prior art wireline conveyed sample chambers, namely the Ruska device previously described. Such sample chambers are conveniently handled in the laboratory for mercury purging procedures and draining procedures. They are designed so that they trap pressurized well fluid samples which are suitable for laboratory PVT analysis.

Additionally, the use of multiple sample chambers in the sampler apparatus 38 provides greater reliability and verification that the sample taken is representative of the formation. If multiple samples are taken and proved to be substantially the same when they reach the laboratory, this is a good indication that each of the samples is in fact representative of the well fluid at the time it was trapped in the well bore. If the samples recovered have the same pressure, this verifies the accuracy of the PVT data in that it can be reliably assumed that pressure is representative of the pressure downhole at the time the sample was taken. In other words, no pressure has leaked off prior to the time the sample reached the laboratory.

The weight of the sample chamber 104 is approximately ten pounds, as compared to approximately an eighty-pound weight of prior art tubing conveyed sample chamber devices such as the Schlumberger device or the Ringgenberg device previously described. This makes for much easier handling both during transport to and once received at the laboratory. Also, it requires much less heating time in the laboratory when the entire container must be heated back to bottom hole temperatures prior to analysis.

ALTERNATIVE EMBODIMENTS OF FIGS. 5C–5D

Figure 5A:
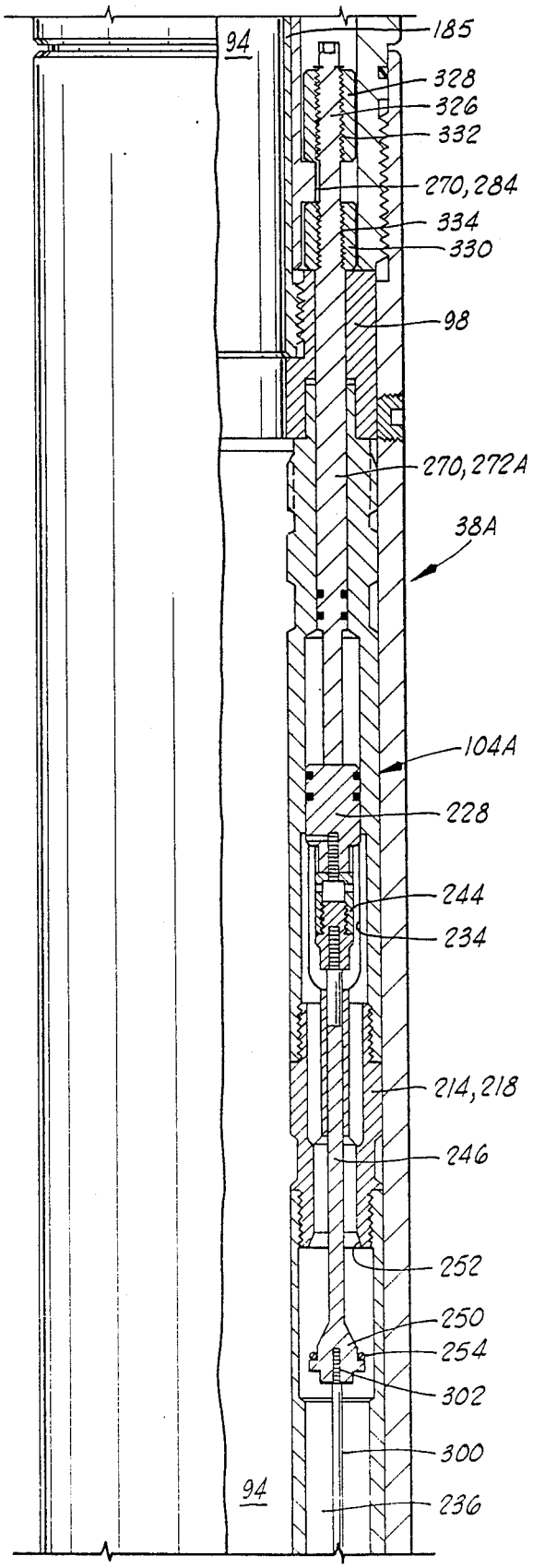
FIGS. 5A–5B comprise an elevation sectioned view similar to FIGS. 2C–2D depicting certain modifications which may be made in the preferred embodiment of FIGS. 2A–2E.
Figure 5B:
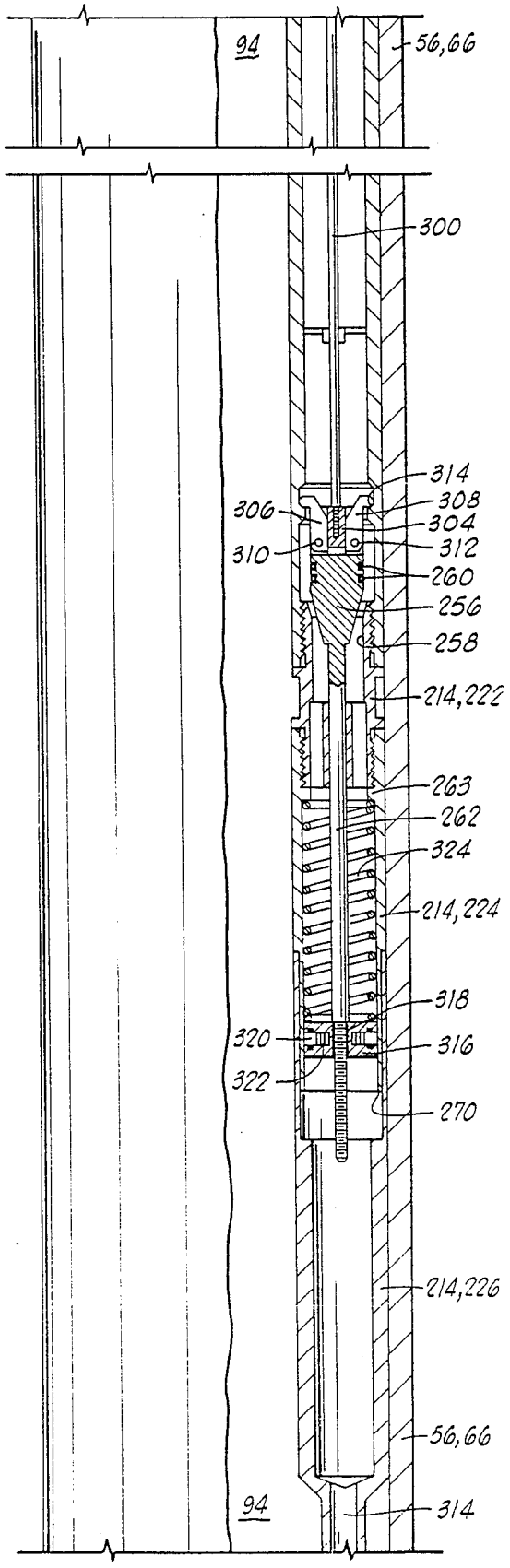

Turning now to FIGS. 5C–5D, a slightly modified version of the apparatus 38 is shown and designated by the numeral 38A. Except for the specific modifications described below, the sampler apparatus 38A is identical to the apparatus 38 previously described.

The apparatus 38A differs in the construction of the upper and lower valve members of the sample chamber 104, and in the actuating means for permitting the upper valve to close.

The sample chamber 104A is designed so that it is initially open at both its upper and lower ends, so that a portion of the well fluid flowing upward through the interior bore 94 of sampler apparatus 38A will flow upward through the interior 236 of sample chamber 104A, until such time as the actuating means allows the sample chamber 104A to close, at which time both the upper and lower valves will move to a closed position.

Turning to FIG. 5C, it is seen that the valve plug 238 has been removed, and the upper valve stem 246 is connected to the piston 228 through connector 244, so that the upper end of interior 236 of sample chamber 104A is communicated with the interior bore 94 of sampler apparatus 38A through the flow port 234. The upper valve head 250 is initially in an open position and is held out of engagement with the upper valve seat 252.

An elongated valve release rod 300 has its upper end connected to upper valve head 250 at threaded connection 302 and has an enlarged diameter head 304 on the lower end thereof which is initially received between a pair of latch dogs 306 and 308 attached to lower valve head 256.

The latch dogs 306 and 308 are pivotally connected to lower valve head 256 at pivot pins 310 and 312, respectively.

In the initial position shown in FIG. 5D, the latch dogs 306 and 308 are held in an outwardly pivoted position by enlarged head 304 so that the latch dogs engage an upper annular shoulder 314 to thus hold the lower valve head 256 above and out of engagement with the bore 258. In this manner, the lower end of interior 236 of sample chamber 104A is communicated with the interior 94 of sampler apparatus 38A through the open lower passage 314 extending through lower end portion 226 of sample chamber housing assembly 214.

An annular latch ring 316 is threadedly connected to a lower end of lower valve stem 262 at threaded connection 318. Latch ring 316 has a plurality of radially directed latch pins 320 received in radial bores thereof, and biased radially outward by coil compression springs 322.

Latch ring 316 has a plurality of longitudinal grooves (not shown) in its outer periphery which permit well fluid to flow upward past latch ring 316 when lower valve head 256 is in its open position as shown in FIG. 5D.

When the upper valve head 250 is moved upward, the valve release rod 300 and head 304 thereof will move upward out of engagement with the latch dogs 306 and 308, allowing a coil compression spring 324 to push the lower valve stem 262 and lower valve head 256 downward until the O-ring seals 260 are received within bore 258 in a position similar to that shown in FIG. 2D to seal the lower end of interior 236 of sample chamber 104A. The radial pins 320 will be biased radially outward when they pass below the lower shoulder 270, thus latching the lower valve head 256 in a closed position.

The actuating stem 272A has also been slightly modified. It has an elongated upward extension portion 326 which has two annular rings 328 and 330 threadedly connected thereto at 332 and 334 on opposite sides of flange 284.

Thus, when the operating mandrel assembly 130 moves upward within the housing assembly 56, it physically pulls the actuating pin 272A upwards.

Upon upward movement of the actuating pin 272A, the piston 228 will operate in a manner similar to that previously described with regard to FIGS. 2A–2E, to close the upper valve head 250, thus releasing and permitting the lower valve head 256 also to close.

It should be noted that the bottom valve 256 may not snap shut quickly, even though it is being urged downwardly by the spring 324. This is due to the opposing forces from relatively rapid upward flow of well fluid through the interior 236.

With the embodiment of FIGS. 5C–5D, there is a slight volumetric increase of the interior 236 of sample chamber 104A, due to the movement of a portion of the stem 246 out of that interior 236. This volumetric increase of interior 236 is accommodated due to the fact that the upper valve head 250 will close relatively slowly thus allowing additional fluid to enter the interior 236.

METHODS OF OPERATION

The testing string 30 will typically be assembled as illustrated in FIG. 1, with the sampler valve apparatus 38 of FIGS. 2A–2E located immediately below the tester valve 36 and the circulation valve 34.

The circulation valve 34, tester valve 36, and sampler apparatus 38 are all preferably constructed to operate in response to annulus pressure.

After the testing string 30 has been lowered into place, and the packer apparatus 48 sealed within the well bore 14 as illustrated in FIG. 1, a program of flow testing of the formation 16 will be conducted by opening and closing the tester valve 36 one or more times to permit formation fluid from the formation 16 to flow upward through the interior of the well test string 30.

The actuation of the tester valve 36 will be in response to an increase in pressure in the upper well annulus 46A to a first level, for example, 1500 psi, to open the tester valve 36. The tester valve 36 will be constructed so that it can be opened and closed multiple times, and so that it will reclose when the well annulus pressure drops substantially below 1500 psi.

The sampler apparatus 38 of FIGS. 2A–2E will be constructed to operate at a second level of well annulus pressure, substantially higher than the first level. For example, when the tester valve 36 is designed for actuation at a well annulus pressure of 1500 psi, the releasable retaining means 186 of the sampler apparatus 38 may be constructed so that the shear pins 194 will shear at a well annulus pressure of approximately 2500 psi.

Accordingly, when it i desired to trap the well fluid samples, the well annulus pressure will be increased to this second predetermined level, for example 2500 psi, and that pressure as communicated through the power port 128 to the piston 132 will shear the shear pins 194 of releasable retaining means 186. The operating mandrel assembly 130 will then be moved upward within the housing assembly 56 until it reaches it upwardmost position where the locking dogs 204 are received in the groove 208.

This upward motion of the operating mandrel assembly 130 will be retarded or delayed in time by the action of the metering cartridge 166. Immediately above the operating piston 132 is a volume of oil contained in the oil chamber 164 immediately below the metering cartridge 166. For the operating mandrel assembly 130 to move upwards, the oil in oil chamber 164 must be forced through the restricted orifice of metering jet 174. The metering jet 174 can be chosen so as to provide a time delay of anywhere from a few seconds to greater than one hour for movement of the operating mandrel assembly 130 to its upwardmost position when subjected to the 2500 psi pressure differential.

Referring now to FIG. 2C, as the operating mandrel assembly 130 moves upward, which as just indicated may be a relatively slow movement, the movement of annular flange 284 thereof will permit the actuating pin 272 to be moved upward by the piston 228 of sample chamber 104. This movement also can be no faster than the upward movement of the operating mandrel assembly 130.

As previously mentioned, as the piston 228 of sample chamber 104 moves upward, the valve plug 238 will initially move above the lower extremity 290 of flow port 234, thus allowing a well fluid sample from the interior bore 94 of sampler apparatus 38 to flow into the empty interior 236 of sample chamber 104. Further upward movement of the piston 228 will move the upper valve head 250 into a closed position in sealing engagement with the upper valve seat 252 thus trapping a sample in the interior 236.

With the sampler apparatus 38 located below the tester valve 36 as shown in FIG. 1, either a flowing well sample or shut-in well sample can be taken.

Recalling that in the example previously described, the tester valve apparatus 36 opens at a well annulus pressure of approximately 1500 psi, and closes when the well annulus pressure is bled back down to zero psi (i.e., to hydrostatic pressure), a flowing well sample would be taken in substantially the following manner. The well annulus pressure would be increased to approximately 2500 psi to shear the shear pins 194, thus releasing the operating mandrel assembly 130. The well annulus pressure would then be maintained at a pressure of at least 2500 psi for sufficient time to move the operating pressure mandrel 130 upward and to allow the sample to be taken and the sample chamber 104 to close. So long as the well annulus pressure is maintained at or above 2500 psi the tester valve apparatus 36 will remain open and the sample taken will be a sample of a flowing stream of well fluid flowing upward through the test string 30.

It should be noted that such a flowing sample could also be taken if the sampler apparatus 38 were located in the test string 14 above the tester apparatus 36, rather than below the tester valve apparatus 36 as in the example just given.

In order to take a shut-in well sample, the sampler apparatus 38 must be located below the tester valve apparatus 36 as shown in FIG. 1, and the well annulus pressure must be manipulated in such a way as to close the tester valve 36 prior to the time that the well fluid sample is trapped. Thus, the well fluid sample which is trapped will be a sample of well fluid which is shut in and is not flowing at the time the sample is taken. This is accomplished in substantially the following manner.

The well annulus pressure must be increased to above 2500 psi in the example given in order to shear the shear pins 194 and start the upward motion of the operating mandrel assembly 130. At the time of shearing of the shear pins 194, the tester valve apparatus 36 will of course be open since the well annulus pressure is at least 2500 psi, which is well above the pressure required to hold the tester valve 36 open.

After the shear pins have been sheared, however, the well annulus pressure will be lowered to zero psi, i.e., to hydrostatic pressure, so that the tester valve 36 will be closed. The difference between the hydrostatic pressure and the substantially ambient pressure above piston 132 is sufficient to continue the upward movement of the operating mandrel assembly 130 of sampler apparatus 38 so as to trap the well fluid sample. At the time the sample is trapped, however, the tester valve 36 will be in a closed position so that the sample taken is a shut-in well sample.

It is the presence of the time delay created by the metering cartridge 166 which permits this shut-in well sample to be taken. If it were not for this built-in time delay, the sampling apparatus would operate very rapidly upon shearing of the shear pins 194 and it would not be possible to reclose the tester valve apparatus 36 prior to the time that the sample was trapped in the sample chamber 104.

In either event, after the samples have been taken and at such time that it is desired to remove the testing string 30 from the well bore 34, the circulating valve 34 will typically be opened so as to communicate the interior of the testing string 30 with the upper well annulus 46A. At that point in time, drilling fluid is pumped from the surface down through the well annulus 46A, then inward through the circulating valve 34 into the interior of test string 30, then upward through the interior of test string 30 to force from the test string 30 the well fluid remaining therein prior to the time that the testing string 30 is pulled from the well bore 14.

It is important that the sample chamber 104 be constructed so that it will remain closed when subjected to the pressures created during this "reverse circulation" procedure.

In the apparatus of both FIGS. 2A–2E and 5C–5D, the lower valve head 256 is latched in its closed position by either the latch ring 268 in FIG. 2D, or the radial latching pins 320 in FIG. 5D.

In both embodiments, the upper valve head 250 is held in its latched position by the upward pressure differential on the piston 228, which may be referred to as a hydraulic latching means for latching the upper valve head 250 of the sample chamber 104 closed after the well fluid sample is trapped therein.

Thus it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art which changes are encompassed within the scope and spirit of the present invention as defined by the appended claims.

What is claimed is:

1. A sampler apparatus for use in a well, comprising:

a housing having a full opening bore therethrough; and a first removable sample chamber means for trapping a well fluid sample, said sample chamber means being removably disposed in said housing in a location such as to avoid restricting said full opening bore regardless of whether said sample chamber means is in an open or closed position, said sample chamber means further having an outside diameter after removal no greater than one-half a difference between an outside diameter of said housing and a diameter of said full opening bore.

2. The apparatus of claim 1, further comprising:

a second such removable sample chamber means disposed in said housing whereby multiple well fluid samples may be simultaneously trapped.

3. The apparatus of claim 2, wherein:

said first and second sample chamber means are elongated sample chamber means having their longitudinal axes oriented substantially parallel to a longitudinal axis of said housing, said first and second sample chamber means being located within said housing at substantially equal elevations and being circumferentially spaced from each other about said longitudinal axis of said housing.

4. The apparatus of claim 1, further comprising:

actuating means, disposed in said housing and operably associated with said sample chamber means, for moving said sample chamber means from its said open position to its said closed position to trap said well fluid sample.

5. The apparatus of claim 4, wherein:

said actuating means is further characterized as being operable in response to a change in well annulus pressure.

6. The apparatus of claim 5, further comprising:

time delay means, disposed in said housing and operably associated with said actuating means, for providing a time delay between said change in well annulus pressure and complete closure of said sample chamber means.

7. The apparatus of claim 6, wherein:

said time delay means is further characterized as a means for allowing a shut-in well fluid sample to be taken after a tester valve located above said sampler apparatus in a well test string is closed.

8. The apparatus of claim 1, wherein:

said sample chamber means is further characterized as a means for trapping a pressurized well fluid sample suitable for laboratory PVT analysis.

9. The apparatus of claim 1, wherein:

said sample chamber means further includes latch means for latching said sample chamber means closed after a well fluid sample is trapped therein.

10. A testing string for use in a well, comprising:

packer means for sealing a well annulus between said testing string and a well bore above a formation to be tested thus defining an upper well annulus above said packer means and a lower well annulus below said packer means;

an annulus pressure responsive tester valve means, operable in response to an increase in pressure in said upper well annulus to a first level, for opening a bore of said testing string to allow flow of well fluid from said formation up through said testing string; and an annulus pressure responsive sampler means, operable in response to an increase in pressure in said upper well annulus to a second level higher than said first level, for trapping a sample of well fluid flowing from said formation up through said testing string, said sampler means including:

a housing having a central passageway disposed therethrough; and a first sample chamber disposed in a location in said housing radially offset from said central passageway, said sample chamber being removable from said housing.

11. The apparatus of claim 10, wherein:

said sampler means is further characterized as including a plurality of said removable sample chambers, said sample chambers being elongated sample chambers having their longitudinal axes oriented substantially parallel to a longitudinal axis of said housing, said plurality of sample chambers being located within said housing at substantially the same longitudinal position and being circumferentially spaced from each other about said longitudinal axis of said housing.

12. The apparatus of claim 11, wherein:

said sampler means is located below said tester valve means and said sampler means further includes:

actuating means, operably associated with said sample chambers, for permitting said sample chambers to move from open positions thereof to closed positions thereof to substantially simultaneously trap multiple well fluid samples in response to said increase in pressure in said upper well annulus to said second level; and time delay means, operably associated with said actuating means, for providing a time delay between said increase in pressure to said second level and complete closure of said sample chambers, and for thereby allowing multiple shut-in well fluid samples to be taken with said tester valve means in a closed position.

13. The apparatus of claim 10, wherein:

said sampler means is further characterized in that said central passageway is a full opening bore.

14. The apparatus of claim 10, wherein:

said sampler means further includes latch means for latching said sampler means closed after a well fluid sample is trapped therein.

15. A sampler apparatus for use in a well, comprising:

a cylindrical housing having a full opening bore defined therethrough and having a power port disposed through a wall thereof;

a differential pressure mandrel having a piston means defined thereon for sliding said mandrel within said housing in response to fluid pressure exterior of said housing communicated to said piston means through said power port.

releasable retaining means, operably associated with said differential pressure mandrel, for releasably retaining said mandrel against sliding movement relative to said housing until a pressure differential across said piston means reaches a predetermined level;

a plurality of removable elongated cylindrical sample chambers removably disposed in said housing substantially parallel to a longitudinal axis of said housing, said sample chambers being circumferentially spaced about said longitudinal axis and radially offset therefrom so as not to restrict said full opening bore of said housing; and actuating means, operably associated with said differential pressure mandrel and said sample chambers for allowing closure of said sample chambers to trap multiple well fluid samples in response to sliding movement of said differential pressure mandrel within said housing.

16. The apparatus of claim 15, further comprising:

time delay means, operably associated with said piston means of said differential pressure mandrel, for providing a time delay in said sliding movement of said mandrel within said housing and in said closure of said sample chambers after said mandrel is released by said releasable retaining means.

17. The apparatus of claim 16, wherein:

said time delay means is a hydraulic time delay means which meters a fluid through a restricted orifice.

18. The apparatus of claim 15, wherein:

said releasable retaining means is a frangible retaining means.

19. The apparatus of claim 18, further comprising:

interior pressure balance means for balancing an interior pressure in said bore of said housing, and a longitudinal force caused thereby, across said frangible retaining means to prevent longitudinal loading of said frangible retaining means due to said interior pressure.

20. The apparatus of claim 15, wherein:

said sample chambers include latch means for latching said sample chambers in a closed position after trapping of said well fluid samples.

* * * * *